US008506330B2

(12) United States Patent
Mizukami et al.

(10) Patent No.: US 8,506,330 B2
(45) Date of Patent: Aug. 13, 2013

(54) MALE AND FEMALE CONNECTORS WITH MODULES HAVING GROUND AND SHIELD PARTS

(75) Inventors: Kazuhiro Mizukami, Tokyo (JP); Toshihiro Kusagaya, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 344 days.

(21) Appl. No.: 13/015,034

(22) Filed: Jan. 27, 2011

(65) Prior Publication Data

US 2011/0189892 A1 Aug. 4, 2011

(30) Foreign Application Priority Data

Jan. 29, 2010 (JP) ..... 2010-019355

(51) Int. Cl.
*H01R 13/648* (2006.01)

(52) U.S. Cl.
USPC ..... 439/607.07

(58) Field of Classification Search
USPC ..... 439/607.07, 607.05, 607.06, 607.11
See application file for complete search history.

(56) References Cited

U.S. PATENT DOCUMENTS

| | | | | |
|---|---|---|---|---|
| 6,168,469 | B1 * | 1/2001 | Lu | 439/607.01 |
| 6,171,115 | B1 * | 1/2001 | Mickievicz et al. | 439/76.1 |
| 6,183,301 | B1 * | 2/2001 | Paagman | 439/607.05 |
| 6,375,508 | B1 * | 4/2002 | Pickles et al. | 439/607.11 |
| 6,390,857 | B1 * | 5/2002 | Pickles et al. | 439/680 |
| 6,409,543 | B1 * | 6/2002 | Astbury et al. | 439/607.07 |
| 6,471,549 | B1 * | 10/2002 | Lappohn | 439/607.05 |
| 6,506,076 | B2 * | 1/2003 | Cohen et al. | 439/607.09 |
| 6,517,360 | B1 * | 2/2003 | Cohen | 439/65 |
| 6,551,140 | B2 * | 4/2003 | Billman et al. | 439/607.07 |
| 6,645,010 | B1 * | 11/2003 | Billman et al. | 439/607.1 |
| 6,652,319 | B1 * | 11/2003 | Billman | 439/607.07 |
| 6,655,966 | B2 * | 12/2003 | Rothermel et al. | 439/76.1 |
| 6,659,808 | B2 * | 12/2003 | Billman et al. | 439/680 |
| 6,663,401 | B2 * | 12/2003 | Billman et al. | 439/76.1 |
| 6,663,429 | B1 * | 12/2003 | Korsunsky et al. | 439/607.07 |
| 6,666,692 | B2 * | 12/2003 | Billman et al. | 439/76.1 |
| 6,776,659 | B1 * | 8/2004 | Stokoe et al. | 439/607.11 |
| 6,824,391 | B2 * | 11/2004 | Mickievicz et al. | 439/61 |
| 6,866,549 | B2 * | 3/2005 | Kimura et al. | 439/701 |
| 6,884,117 | B2 * | 4/2005 | Korsunsky et al. | 439/607.11 |
| 7,047,086 | B2 * | 5/2006 | Taskiran et al. | 607/126 |

(Continued)

FOREIGN PATENT DOCUMENTS

| | | |
|---|---|---|
| JP | 2005-522012 | 7/2005 |
| JP | 2009-218119 | 9/2009 |
| WO | WO03-085785 | 10/2003 |

*Primary Examiner* — Neil Abrams
(74) *Attorney, Agent, or Firm* — IPUSA, PLLC

(57) ABSTRACT

A male connector includes male connector modules placed in tiers and having respective first and second surfaces facing away from each other. The male connector modules each includes interconnection parts for electrical signal transmission on the first surface; a male connector ground part formed on the second surface so as to substantially cover the second surface; male connector contact parts provided at respective first ends of the interconnection parts on the first surface; male connector terminal parts joined to respective second ends of the interconnection parts on the first surface; and a male connector shield part provided on the side on which the male connector is configured to be connected to a female connector to be connected to the male connector ground and project relative to ends of the male connector contact parts in a direction in which the male connector is configured to be connected to the female connector.

13 Claims, 26 Drawing Sheets

(56) References Cited

U.S. PATENT DOCUMENTS

| | | | | |
|---|---|---|---|---|
| 7,074,086 | B2 * | 7/2006 | Cohen et al. | 439/607.08 |
| 7,175,445 | B2 * | 2/2007 | Consoli et al. | 439/79 |
| 7,267,515 | B2 * | 9/2007 | Lappohn | 439/607.07 |
| 7,331,802 | B2 * | 2/2008 | Rothermel et al. | 439/108 |
| 7,371,117 | B2 * | 5/2008 | Gailus | 439/607.08 |
| 7,381,092 | B2 * | 6/2008 | Nakada | 439/607.1 |
| 7,686,618 | B2 | 3/2010 | Mizukami et al. | |
| 7,780,474 | B2 * | 8/2010 | Ito | 439/607.05 |
| 7,837,475 | B2 * | 11/2010 | Mizukami et al. | 439/65 |
| 7,985,097 | B2 * | 7/2011 | Gulla | 439/607.39 |
| 8,083,553 | B2 * | 12/2011 | Manter et al. | 439/701 |
| 8,157,591 | B2 * | 4/2012 | Fedder et al. | 439/607.07 |
| 8,298,015 | B2 * | 10/2012 | Cohen et al. | 439/607.1 |
| 2011/0189892 | A1 * | 8/2011 | Mizukami et al. | 439/607.34 |
| 2011/0256763 | A1 * | 10/2011 | De Geest et al. | 439/607.01 |
| 2012/0135641 | A1 * | 5/2012 | Okuyama et al. | 439/626 |

* cited by examiner

MALE AND FEMALE CONNECTORS WITH MODULES HAVING GROUND AND SHIELD PARTS

CROSS-REFERENCE TO RELATED APPLICATION

The present application is based upon and claims the benefit of priority of Japanese Patent Application No. 2010-019355, filed on Jan. 29, 2010, the entire contents of which are incorporated herein by reference.

BACKGROUND OF THE INVENTION

1. Field of the Invention

The present invention relates to a male connector, a female connector, and a connector.

2. Description of the Related Art

Some communication devices internally have a backplane and multiple boards connected substantially perpendicularly to the backplane. Plug connectors or jack connectors are attached to the backplane. A corresponding jack connector or plug connector is attached to one end of each of the boards to be connected. The backplane and each of the boards are electrically connected by connecting the jack connector and the plug connector.

In recent years, signal transmission rates have become higher, and some connectors, formed of the jack connector and the plug connector, have multiple signal transmission contacts two-dimensionally arranged and closely incorporated.

For related art, reference may be made to, for example, Japanese Laid-Open Patent Application No. 2009-218119 and Japanese National Publication of International Patent Application No. 2005-522012.

SUMMARY OF THE INVENTION

According to one aspect of the present invention, a male connector configured to be connected to a female connector includes a plurality of male connector modules placed in a plurality of tiers and having respective first and second surfaces facing away from each other, the male connector modules each including a plurality of interconnection parts for electrical signal transmission on the first surface; a male connector ground part formed on the second surface so as to substantially cover the second surface; a plurality of male connector contact parts provided at respective first ends of the interconnection parts on the first surface; a plurality of male connector terminal parts joined to respective second ends of the interconnection parts on the first surface; and a male connector shield part provided on a side on which the male connector is configured to be connected to the female connector, the male connector shield part being connected to the male connector ground and projecting relative to ends of the male connector contact parts in a direction in which the male connector is configured to be connected to the female connector.

According to one aspect of the present invention, a female connector configured to be connected to a male connector includes a plurality of female connector modules placed in a plurality of tiers, the female connector modules each including a plurality of elastic female connector contact parts and a plurality of elastic female connector ground contact parts provided on a first side of the female contact module; a plurality of female connector terminal parts and a plurality of female connector ground terminal parts provided on a second side of the female contact module opposite to the first side, the female connector terminal parts being joined to the corresponding female connector contact parts; and a female connector shield part provided on the first side so as to cover the female connector terminal parts, the female connector shield part being connected to the female connector ground contact parts, wherein the female connector ground terminal parts are joined to the female connector shield part.

According to one aspect of the present invention, a connector includes a male connector; and a female connector, wherein the male connector includes a plurality of male connector modules placed in a plurality of tiers and having respective first and second surfaces facing away from each other, the male connector modules each including a plurality of interconnection parts for electrical signal transmission on the first surface; a male connector ground part formed on the second surface so as to substantially cover the second surface; a plurality of male connector contact parts provided at respective first ends of the interconnection parts on the first surface; a plurality of male connector terminal parts joined to respective second ends of the interconnection parts on the first surface; and a male connector shield part provided on a side on which the male connector is connected to the female connector, the male connector shield part being connected to the male connector ground and projecting relative to ends of the male connector contact parts in a direction in which the male connector is connected to the female connector, the female connector includes a plurality of female connector modules placed in a plurality of tiers, the female connector modules each including a plurality of elastic female connector contact parts and a plurality of elastic female connector ground contact parts provided on a first side of the female contact module; a plurality of female connector terminal parts and a plurality of female connector ground terminal parts provided on a second side of the female contact module opposite to the first side, the female connector terminal parts being joined to the corresponding female connector contact parts; and a female connector shield part provided on the first side so as to cover the female connector terminal parts, the female connector shield part being connected to the female connector ground contact parts, wherein the female connector ground terminal parts are joined to the female connector shield part, and the male connector contact parts and the female connector contact parts are in contact and the female connector ground contact parts and the male connector shield part are in contact with the male connector and the female connector being fit to each other.

The object and advantages of the embodiments will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

As described above, some connectors have multiple signal transmission contacts two-dimensionally arranged and closely incorporated. However, in such connectors where signal transmission contacts are two-dimensionally arranged, a transmission signal may contain much noise because of crosstalk between signal transmission contacts, which are closely arranged. Further, there is a demand for connectors with better impedance matching because of a demand for higher frequencies.

According to one aspect of the present invention, there are provided a male connector, a female connector, and a connector that have two-dimensionally arranged signal transmission contacts for electrically connecting a board and a backplane and are low in crosstalk and excellent in high-frequency characteristics.

A description is given below, with reference to the accompanying drawings, of embodiments of the present invention.

[a] First Embodiment

A description is given of a first embodiment. This embodiment illustrates a connector (or a connector unit), including a male connector and a female connector, for connecting a backplane and a board.

Figure 1:
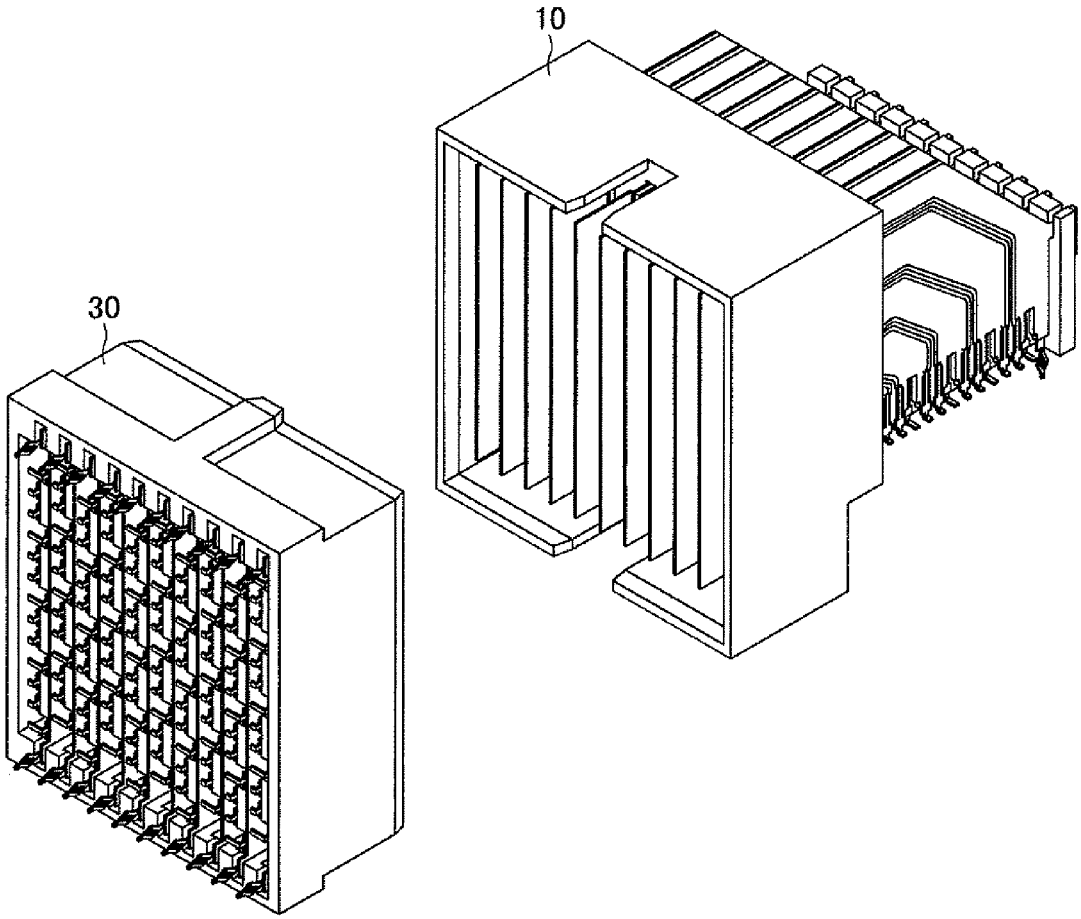
FIG. 1 is a perspective view of a male connector and a female connector forming a connector according to a first embodiment of the present invention.

FIG. 1 illustrates a male connector 10 and a female connector 30 according to this embodiment.

The male connector 10 is attached to a board (not graphically illustrated). The female connector 30 is attached to a below-described backplane board (not graphically illustrated). The backplane board and the board are electrically connected by electrically connecting the male connector 10 and the female connector 30.

[Male Connector]

A description is given, based on FIG. 2A through FIG. 6B, of the male connector 10.

Figure 2F:
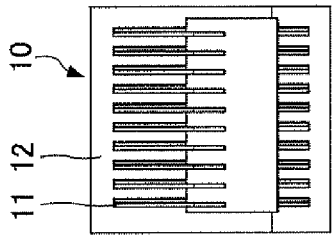
FIGS. 2A through 2F are structural diagrams illustrating the male connector according to the first embodiment of the present invention.
Figure 2E:
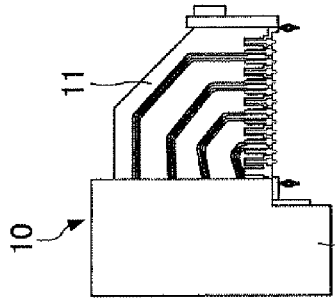
Figure 2A:
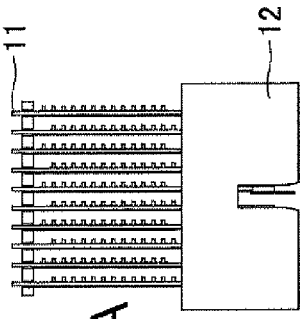
Figure 2C:
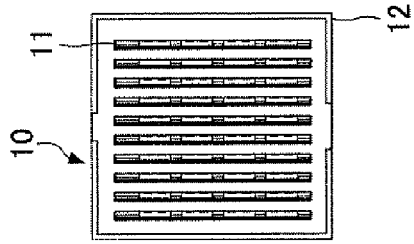
Figure 2D:
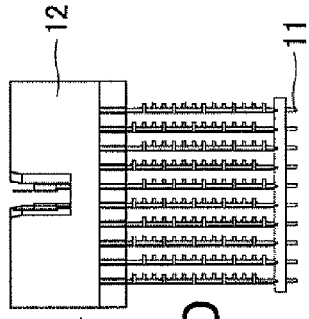
Figure 2B:
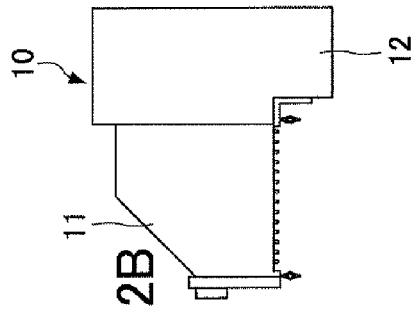
Figure 3A:
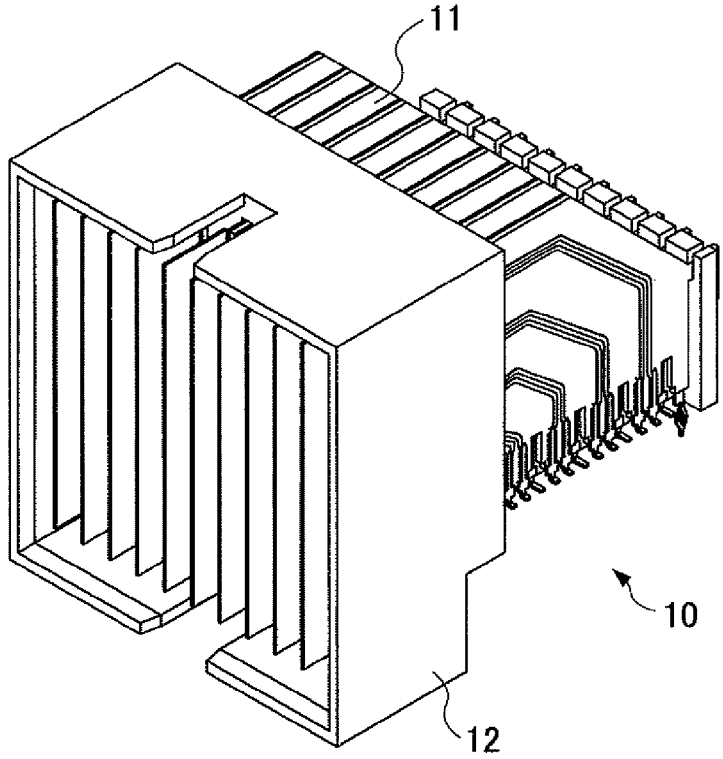
FIGS. 3A and 3B are perspective views of the male connector according to the first embodiment of the present invention.
Figure 3B:
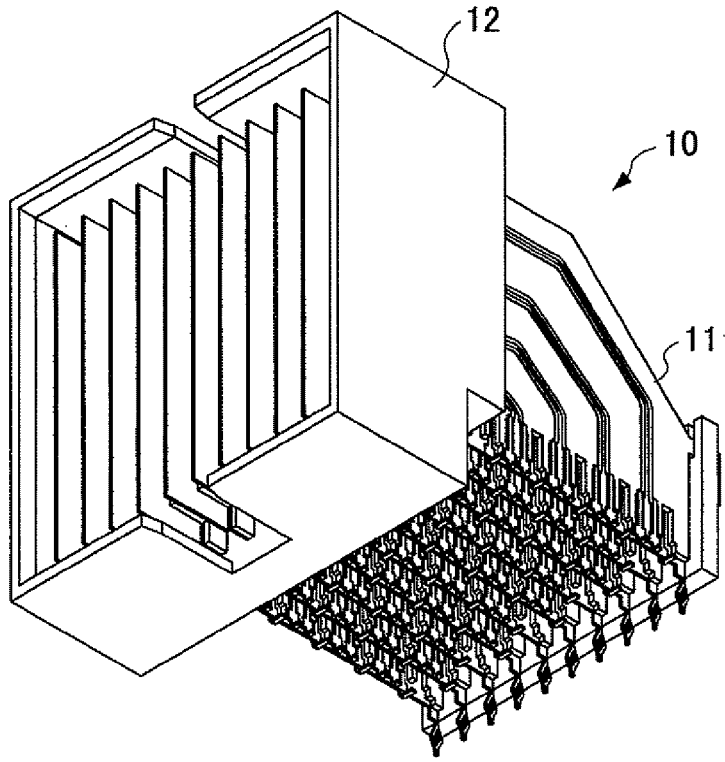

FIGS. 2A through 2F and FIGS. 3A and 3B illustrate the male connector 10 according to this embodiment. FIG. 2A is a rear view, FIG. 2B is a left-side view, FIG. 2C is a bottom plan view, FIG. 2D is a front view, FIG. 2E is a right-side view, and FIG. 2F is a top plan view of the male connector 10. FIG. 3A is a perspective view of the male connector 10, illustrating its bottom, rear, and right side, and FIG. 3B is a perspective view of the male connector 10, illustrating its bottom, front, and right side.

The male connector 10 according to this embodiment includes multiple flat-plate male connector modules 11. The male connector modules 11 are arranged in a direction perpendicular to their surfaces. Further, the male connector 10 includes a housing part 12 provided on the side on which the male connector 10 is to be connected to the female connector 30 so as to fix the arrangement of the male connector modules 11. As described below, each of the male connector modules 11 is provided with multiple male connector contact parts and male connector terminal parts for signal transmission. Since the male connector 10 includes the multiple male connector modules 11, the male connector contact parts and the male connector terminal parts are two-dimensionally arranged.

Figure 4A:
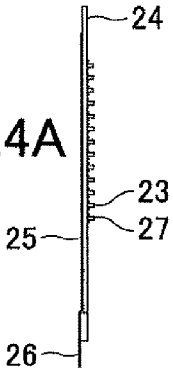
FIGS. 4A through 4F are structural diagrams illustrating a male connector module according to the first embodiment of the present invention.
Figure 4B:
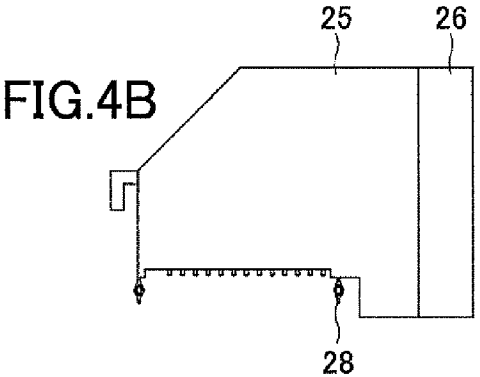
Figure 4C:
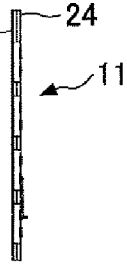
Figure 4D:
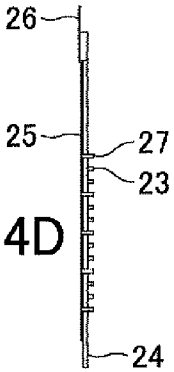
Figure 4E:
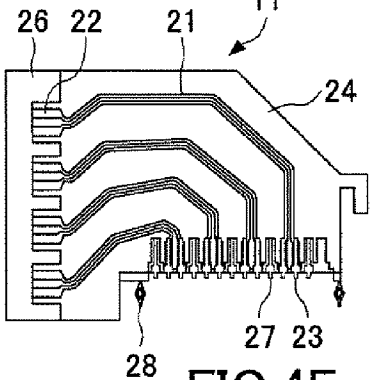
Figure 4F:
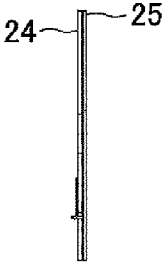
Figure 5:
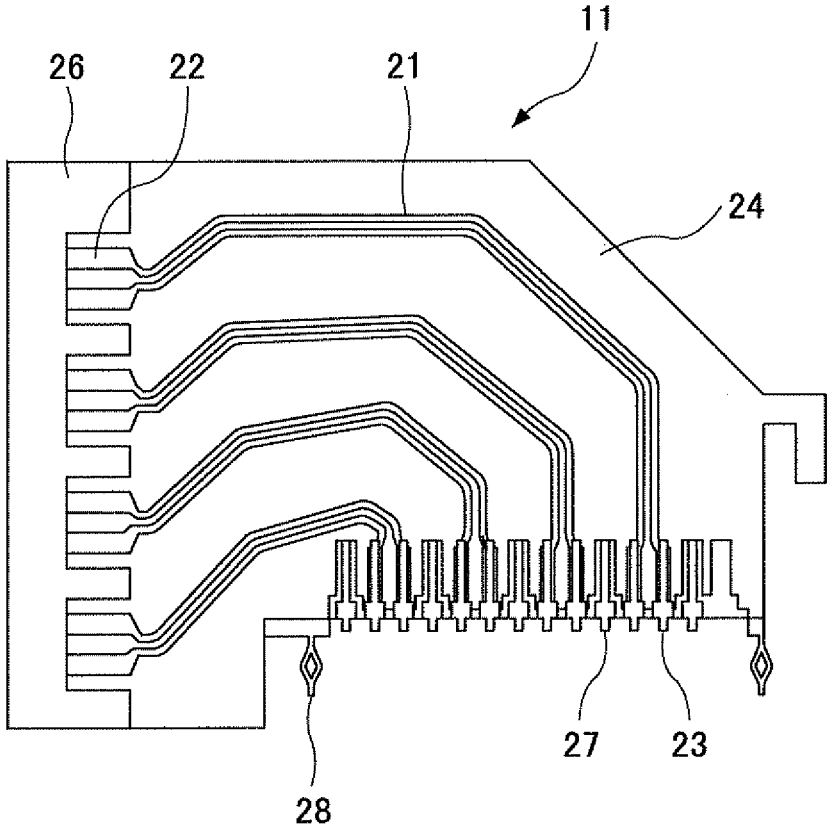
FIG. 5 is an enlarged view of FIG. 4E according to the first embodiment of the present invention.
Figure 6A:
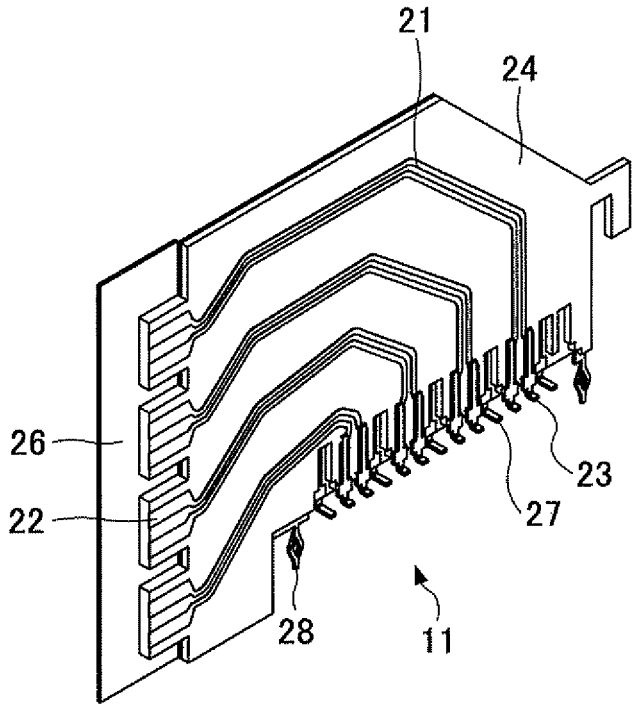
FIGS. 6A and 6B are perspective views of the male connector module according to the first embodiment of the present invention.
Figure 6B:
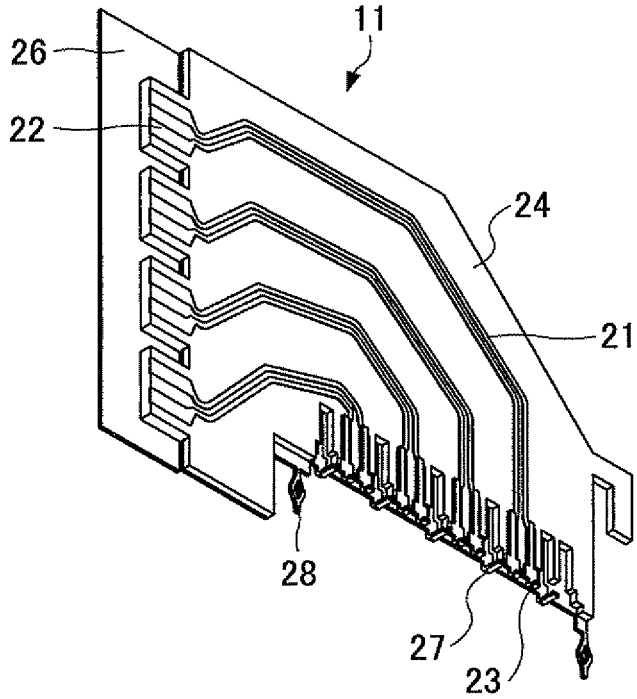

FIGS. 4A through 4F, FIG. 5, and FIGS. 6A and 6B illustrate one of the male connector modules 11 of the male connector 10. FIG. 4A is a rear view, FIG. 4B is a left-side view, FIG. 4C is a bottom plan view, FIG. 4D is a front view, FIG. 4E is a right-side view, and FIG. 4F is a top plan view of the male connector module 11. FIG. 5 is an enlarged view of FIG. 4E. FIG. 6A is a perspective view of the male connector module 11, illustrating its bottom, rear, and right side, and FIG. 6B is a perspective view of the male connector module 11, illustrating its bottom, front, and right side.

Multiple interconnection parts 21 for signal transmission are provided on a surface of the male connector module 11 on one side (first side). Each of the interconnection parts 21 has a male connector contact part 22 for connection to a female connector contact part of the female connector 30 provided at one end, and has a male connector terminal part 23 for connection to a terminal of a board (not graphically illustrated) provided at the other end. The interconnection parts 21, the male connector contact parts 22, and the male connector terminal parts 23 are formed of a conductive material such as a metal material on a surface of an insulating substrate 24 on the first side. The male connector contact parts 22 are wide (in their arrangement directions) for contact with corresponding female connector contact parts.

Further, on the other side (second side) of the male connector module 11, a male connector ground part 25 is formed of a conductive material such as a metal material on the entire surface of the insulating substrate 24 to be connected to a male connector shield part 26 provided on the side of connection to the female connector 30. Further, male connector ground terminal parts 27 to be connected to the board (not graphically illustrated) are joined to the male connector ground part 25.

Further, multiple press-fit pins 28 joined to the male connector ground part 25 are provided one at each end of the male connector module 11 on the side of connection to the board. The press-fit pins 28 are inserted into corresponding through holes in the board (not graphically illustrated) so that the press-fit pins 28 are electrically connected to the board and the male connector 10 is fixed to the board.

The male connector shield part 26 is formed to project relative to the ends of the male connector contact parts 22 in a direction in which the male connector 10 is to be connected to the female connector 30. Further, the male connector ground part 25, which may be formed on the substantially entire surface of the male connector module 11 on its second side, serves as an electromagnetic shield between the male connector module 11 and an adjacent male connector module 11. That is, the male connector ground part 25 is capable of providing a shield from noise generated from the interconnection parts 21, the male connector contact parts 22, and the male connector terminal parts 23 and thus preventing the occurrence of crosstalk between different male connector modules 11 adjacently disposed. Further, the male connector terminal parts 23 and the interconnection parts 21 are joined with solder or an electrically conductive adhesive agent, and the male connector ground terminal parts 27 and the male connector ground part 25 are joined with solder or an adhesive agent. Examples of conductive paste that may be used as an electrically conductive adhesive agent include silver (Ag) paste, nickel (Ni) paste, gold (Au) paste, palladium (Pd) paste, and carbon (C) paste.

[Female Connector]

Figure 7F:
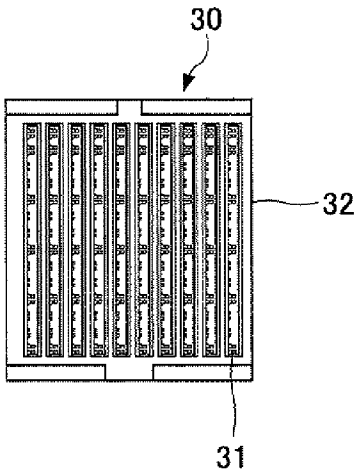
FIGS. 7A through 7F are structural diagrams illustrating the female connector according to the first embodiment of the present invention.
Figure 7E:
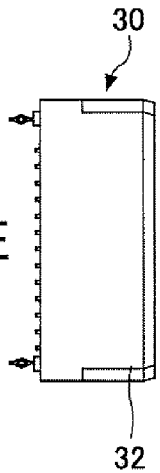
Figure 7A:
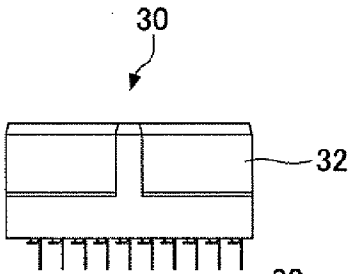

Next, a description is given, based on FIG. 7A through FIG. 115, of the female connector 30.

Figure 7C:
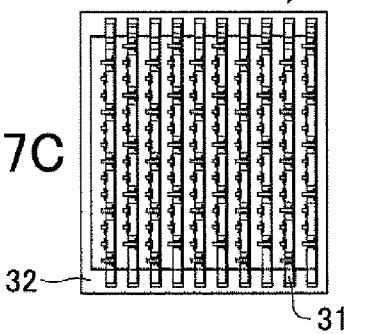
Figure 7D:
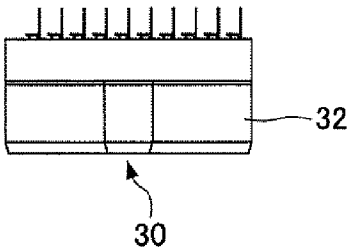
Figure 7B:
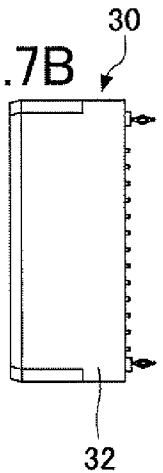
Figure 8A:
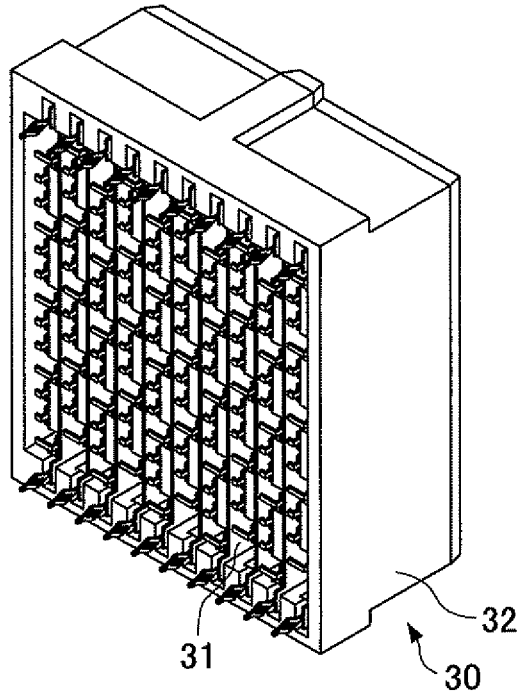
FIGS. 8A and 8B are perspective views of the female connector according to the first embodiment of the present invention.
Figure 8B:
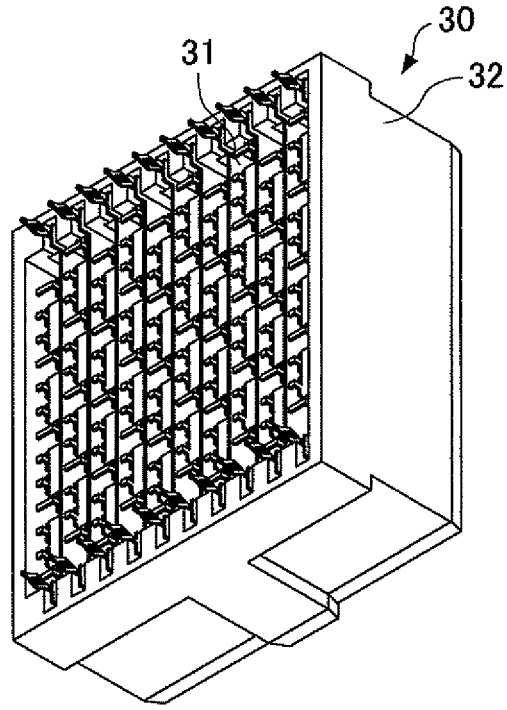

FIGS. 7A through 7F and FIGS. 8A and 8B illustrate the female connector 30 according to this embodiment. FIG. 7A is a rear view, FIG. 7B is a left-side view, FIG. 7C is a bottom plan view, FIG. 7D is a front view, FIG. 7E is a right-side view, and FIG. 7F is a top plan view of the female connector 30. FIG. 8A is a perspective view of the female connector 30, illustrating its bottom, rear, and right side, and FIG. 85 is a perspective view of the female connector 30, illustrating its bottom, front, and right side.

The female connector 30 according to this embodiment includes multiple flat-plate female connector modules 31. The female connector modules 31 are arranged in a direction perpendicular to their surfaces. Further, the female connector 30 includes a housing part 32 provided on the side on which the female connector 30 is to be connected to the male connector 10 so as to fix the arrangement of the female connector modules 31. As described below, each of the female connector modules 31 is provided with multiple female connector contact parts and female connector terminal parts for signal transmission. Since the female connector 30 includes the multiple female connector modules 31, the female connector contact parts and the female connector terminal parts are two-dimensionally arranged.

Figure 9F:
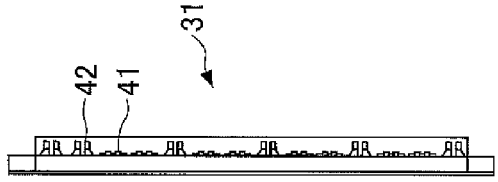
FIGS. 9A through 9F are structural diagrams illustrating a female connector module according to the first embodiment of the present invention.
Figure 9E:
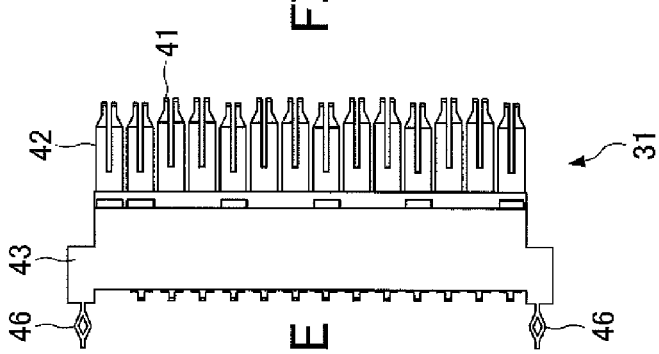
Figure 9A:
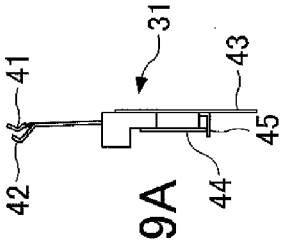
Figure 9C:
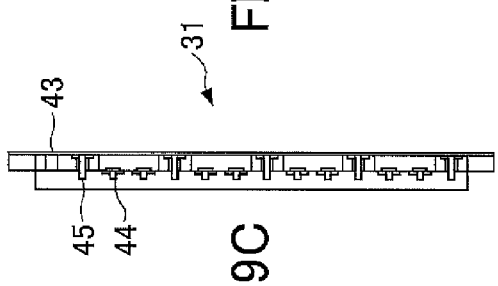
Figure 9D:
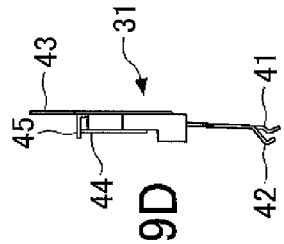
Figure 9B:
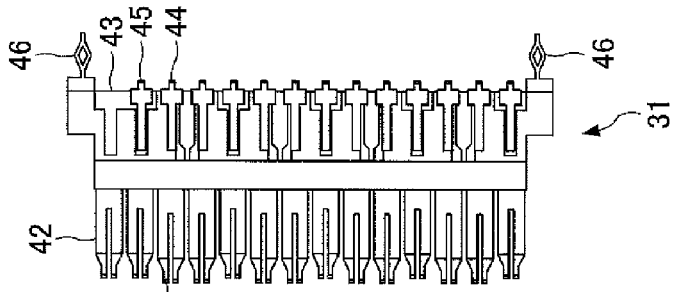
Figure 10:
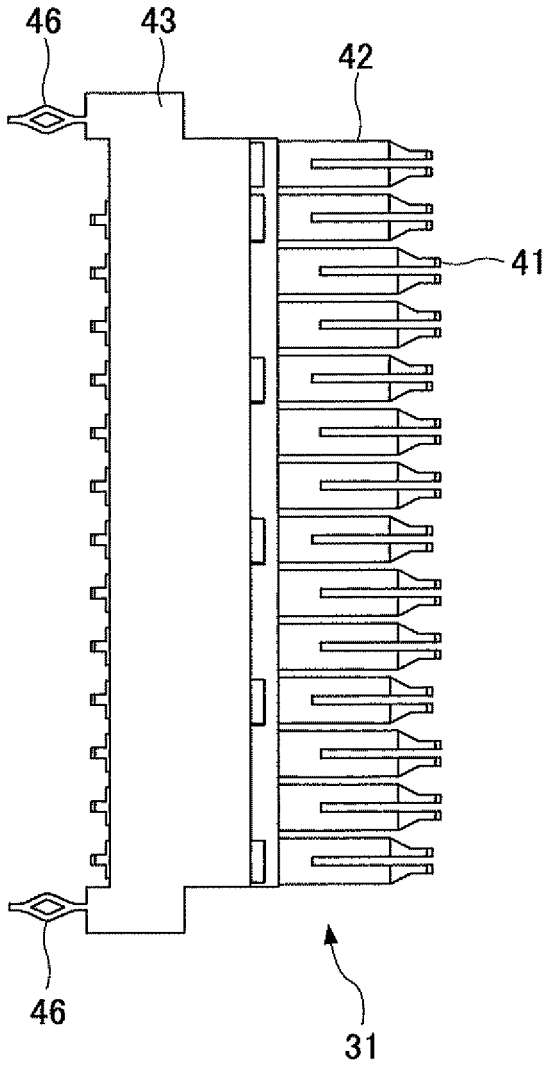
FIG. 10 is an enlarged view of FIG. 9E according to the first embodiment of the present invention.
Figure 11A:
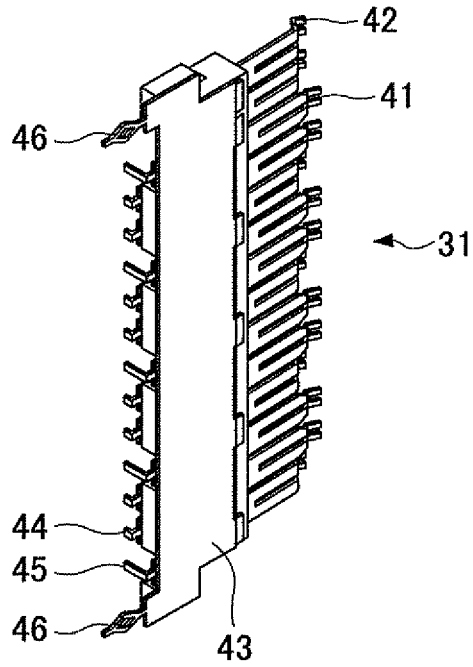
FIGS. 11A and 11B are perspective views of the female connector module according to the first embodiment of the present invention.
Figure 11B:
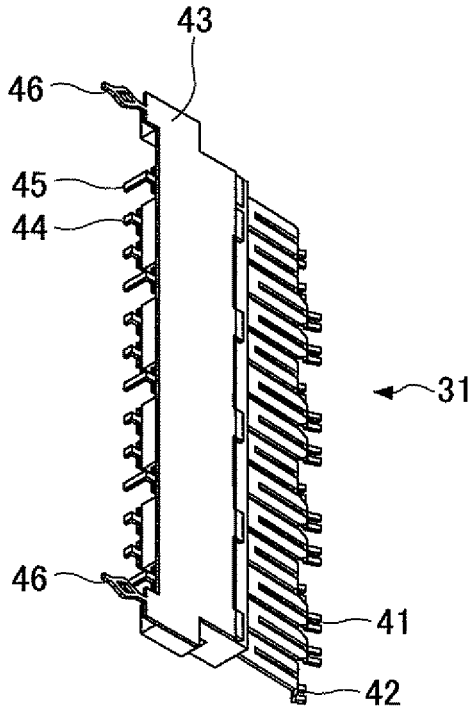

FIGS. 9A through 9F, FIG. 10, and FIGS. 11A and 11B illustrate one of the female connector modules 31 of the female connector 30. FIG. 9A is a rear view, FIG. 9B is a left-side view, FIG. 9C is a bottom plan view, FIG. 9D is a front view, FIG. 9E is a right-side view, and FIG. 9F is a top plan view of the female connector module 31. FIG. 10 is an enlarged view of FIG. 9E. FIG. 11A is a perspective view of the female connector module 31, illustrating its bottom, rear, and right side, and FIG. 11B is a perspective view of the female connector module 31, illustrating its bottom, front, and right side.

The female connector module 31 has spring-like female connector contact parts 41 and spring-like female connector ground contact parts 42 on the side of connection to the male connector 10. Further, a female connector shield part 43 is provided on a surface of the female connector module 31 on one side (first side), and female connector terminal parts 44 joined to the female connector contact parts 41 and female connector ground terminal parts 45 joined to the female connector shield part 43 are exposed on a surface of the female connector module 31 on the other side (second side). The female connector ground contact parts 42 are connected to the female connector shield part 43.

For example, the female connector shield part 43, which is formed on the surface of the female connector module 31 on the side opposite to the female connector terminal parts 44 and the female connector ground terminal parts 45 so as to cover the female connector terminal parts 44, serves as an electromagnetic shield and can therefore prevent the occurrence of crosstalk between the female connector module 31 and an adjacent female connector module 31. Further, multiple press-fit pins 46 connected to the female connector shield part 43 are provided one at each end of the female connector module 31 on the side of connection to the backplane board (not graphically illustrated). The press-fit pins 46 are inserted into corresponding through holes in the backplane board (not graphically illustrated) so that the press-fit pins 46 are electrically connected to the backplane board and the female connector 30 is fixed to the backplane board.

Like in the case of the male connector module 11, in the female connector module 31, the female connector terminal parts 44 and the female connector contact parts 41 are connected with solder or an electrically conductive adhesive agent, and the female connector ground terminal parts 45 and the female connector shield part 43 are connected with solder or an electrically conductive adhesive agent. Examples of conductive paste that may be used as an electrically conductive adhesive agent include silver (Ag) paste, nickel (Ni) paste, gold (Au) paste, palladium (Pd) paste, and carbon (C) paste.

[Fitting of Male Connector and Female Connector]

Next, a description is given, based on FIG. 12A through FIG. 16, of the fitting of the male connector 10 and the female connector 30 according to this embodiment.

Figure 12F:
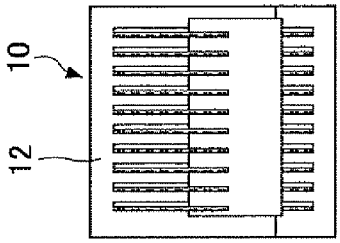
FIGS. 12A through 12F are structural diagrams illustrating the connector in a joined state according to the first embodiment of the present invention.
Figure 12E:
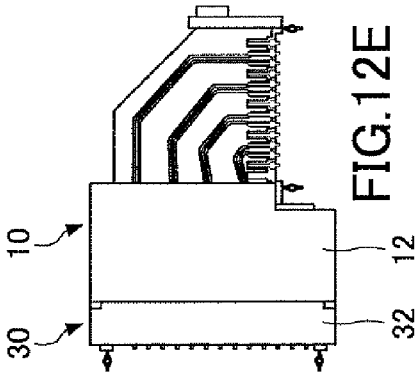
Figure 12A:
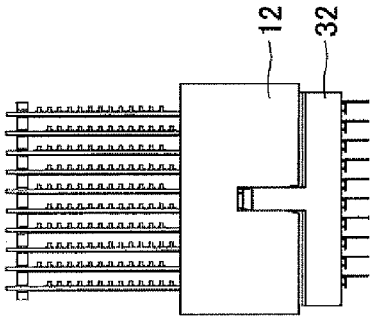
Figure 12C:
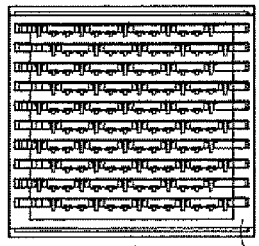
Figure 12D:
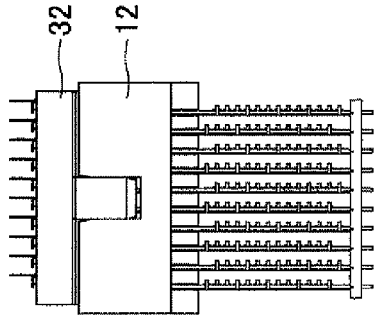
Figure 12B:
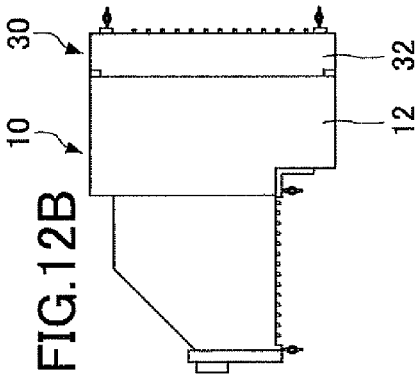
Figure 13A:
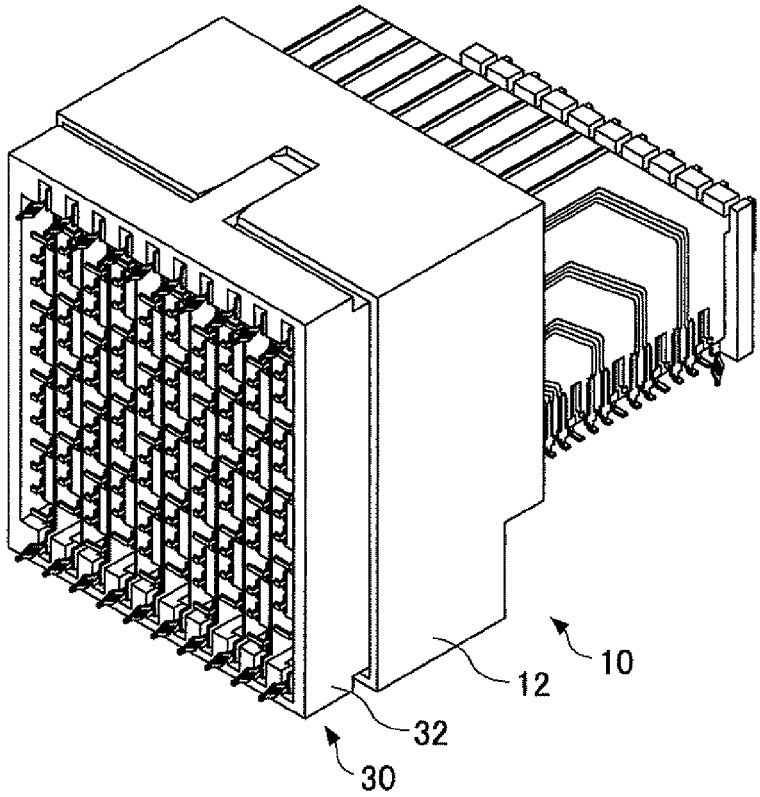
FIGS. 13A and 13B are perspective views of the connector in a joined state according to the first embodiment of the present invention.
Figure 13B:
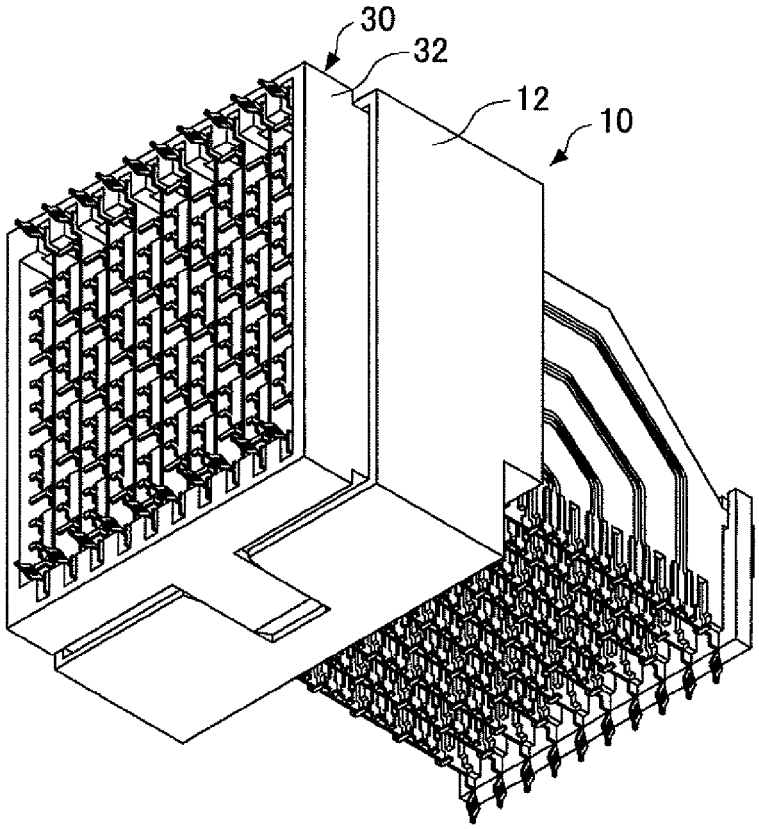

FIGS. 12A through 12F and FIGS. 13A and 13B are diagrams illustrating the fitting of the male connector 10 and the female connector 30 according to this embodiment. FIG. 12A is a rear view, FIG. 12B is a left-side view, FIG. 12C is a bottom plan view, FIG. 12D is a front view, FIG. 12E is a right-side view, and FIG. 12F is a top plan view of the male connector 10 and the female connector 30 in a fit state. FIG. 13A is a perspective view of the male connector 10 and the female connector 30 in the fit state, illustrating their bottom, rear, and right side, and FIG. 13B is a perspective view of the male connector 10 and the female connector 30 in the fit state, illustrating their bottom, front, and right side.

The connector according to this embodiment includes the male connector 10 and the female connector 30. When the male connector 10 and the female connector 30 are fit to each other, the housing part 32 of the female connector 30 enters part of the housing part 12 of the male connector 10.

Next, a description is given, based on FIG. 14A through FIG. 16, of the inside (interior condition) of the male connector 10 and the female connector 30 in the fit state.

Figure 14B:
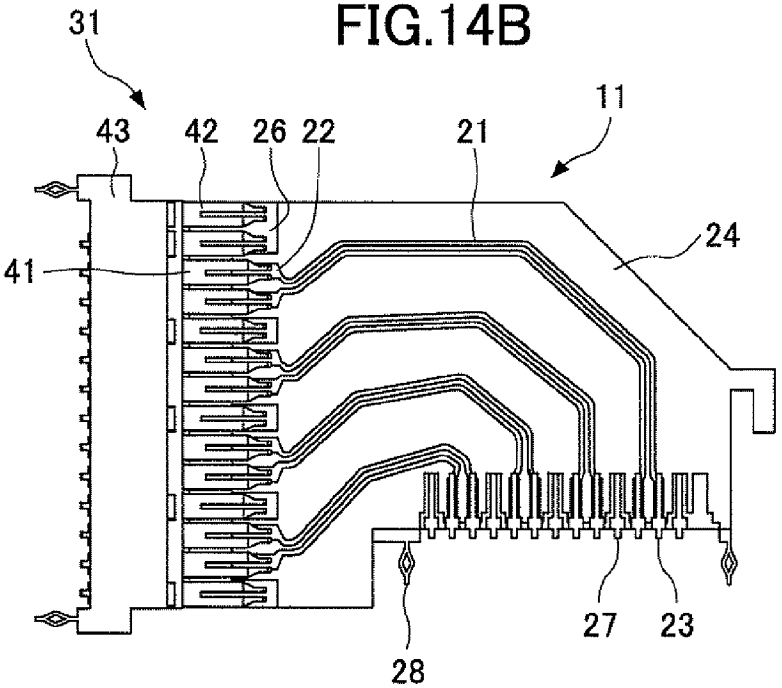
FIGS. 14A and 14B are structural diagrams illustrating the male connector module and the female connector module in the joined state according to the first embodiment of the present invention.
Figure 14A:
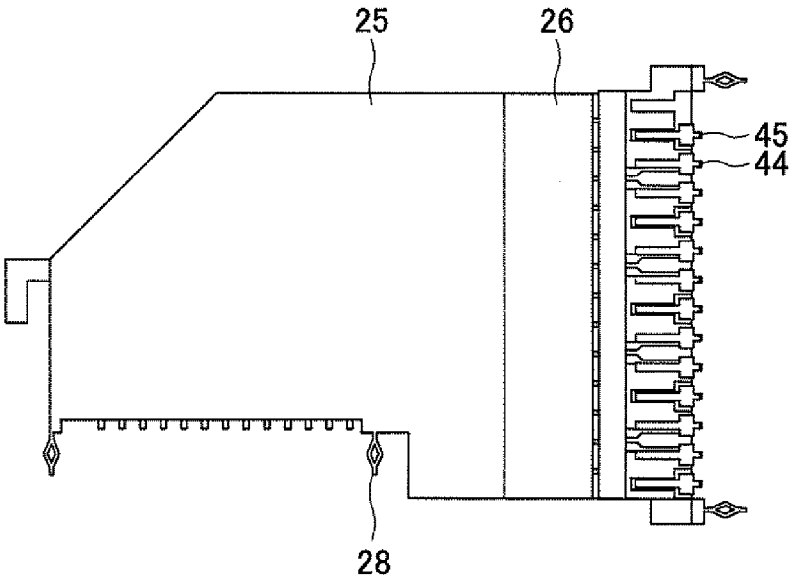
Figure 15A:
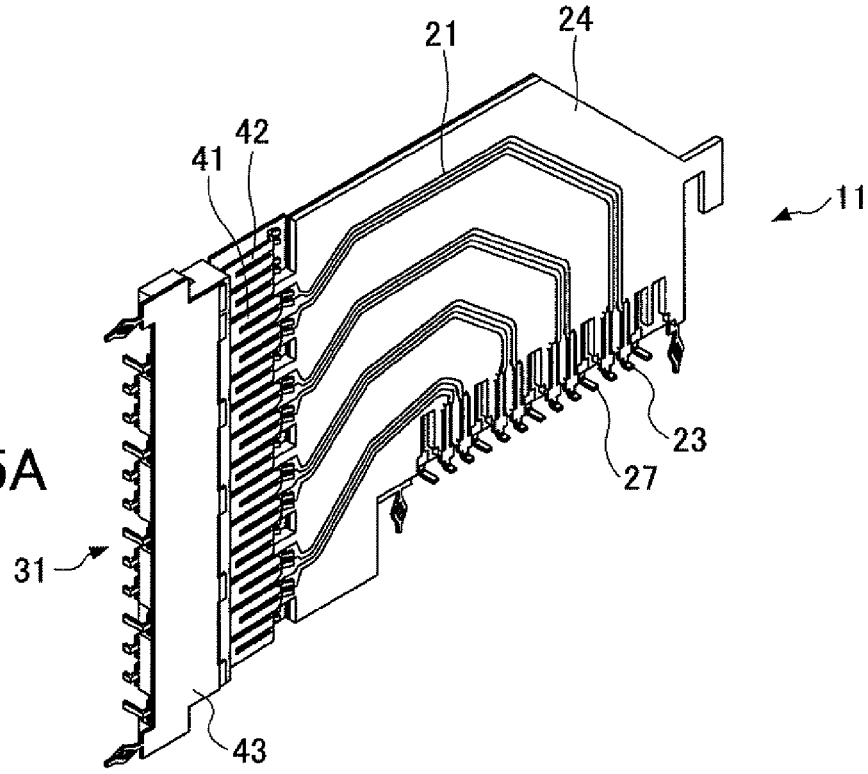
FIGS. 15A and 15B are perspective views of the male connector module and the female connector module in the joined state according to the first embodiment of the present invention.
Figure 15B:
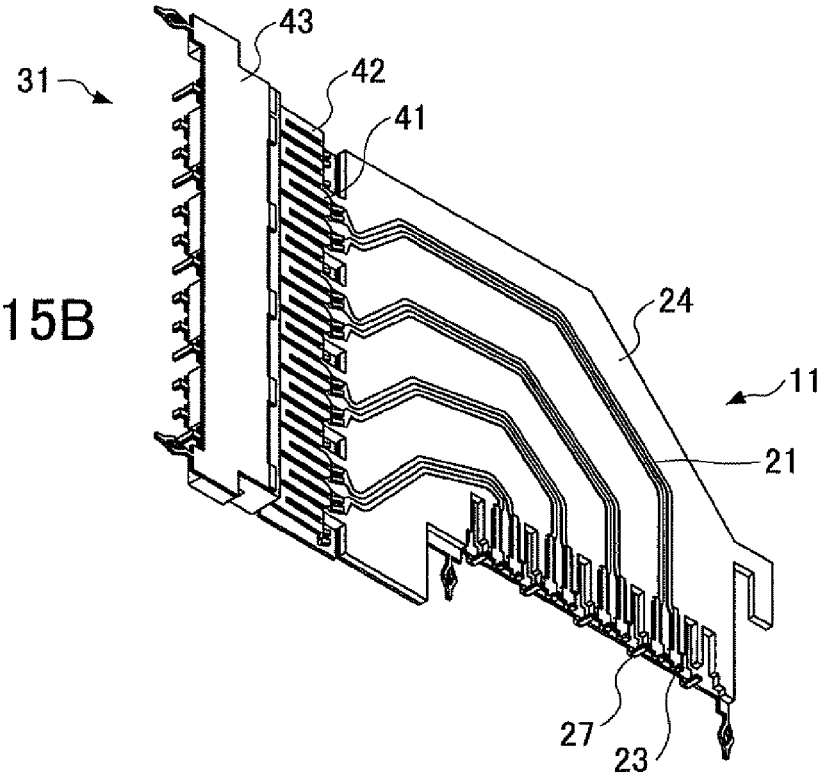

FIGS. 14A and 14B and FIGS. 15A and 15B are diagrams illustrating the male connector module 11 and the female connector module 31 of the male connector 10 and the female connector 30 in the fit (joined) state. FIG. 14A is a left-side view and FIG. 14B is a right-side view of the male connector module 11 and the female connector module 31 fit (joined) to each other. FIG. 15A is a perspective view of the female connector module 31 fit (joined) to each other, illustrating their bottom, rear, and right side, and FIG. 15B is a perspective view of the female connector module 31 fit (joined) to each other, illustrating their bottom, front, and right side.

With the male connector 10 and the female connector 30 in the fit state, the elastically formed female connector contact parts 41 of the female contact module 31 are in contact with and electrically connected to the corresponding male connector contact parts 22 of the male connector module 11. Further, the elastically formed female connector ground contact parts 42 of the female connector module 31 are in contact with the male connector shield part 26 of the male connector module 11. Since the female connector contact parts 41 and the female connector ground contact parts 42 are in contact with the male connector contact parts 22 and the male connector shield part 26, respectively, on the surface of the male connector module 11 on the same side, the female connector contact parts 41 may be closer (in a direction in which the female contact modules 31 [or the male contact modules 11] are placed or arranged at intervals in multiple tiers), and the male connector 10 and the female connector 30 may be further reduced in size. In this case, the female connector contact parts 41 are shielded by the male connector shield part 26.

Figure 16:
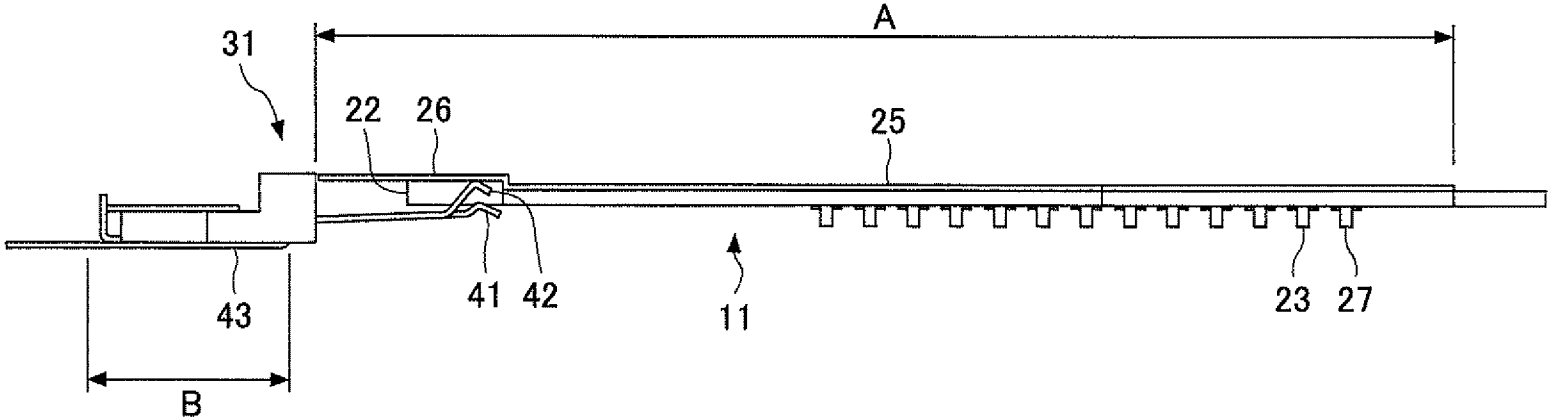
FIG. 16 is a diagram illustrating the male connector module and the female connector module in the joined state according to the first embodiment of the present invention.

A description is given in more detail based on FIG. 16. Referring to FIG. 16, a portion of the joined structure of the male connector module 11 and the female connector module 31 indicated by double-headed arrow A (region A) is shielded with the male connector ground part 25 and the male connector shield part 26 formed in the male connector module 11, and a portion of the female connector module 31 joined to the male connector module 11 indicated by double-headed arrow B (region B) is shielded with the female connector shield part 43 formed in the female connector module 31. Accordingly, the female connector contact parts 41 in the female connector module 31 are shielded with the male connector shield part 26 formed in the male connector module 11 shown in region A. In the state where the male connector 10 and the female connector 30 are thus fit, the male connector module 11 and the female connector module 31 are globally shielded with the male connector ground part 25, the male connector shield part 26, and the female connector shield part 43, so that it is possible to prevent the occurrence of crosstalk.

In the male connector module 11, the male connector shield part 26 is longer (projects further) in the direction of connection to the female connector module 31 than the male connector contact parts 22, so that the male connector shield part 26 projects in the connection direction relative to the ends of the male connector contact parts 22. Therefore, the female connector ground contact parts 42 of the female connector module 31 come into contact with the male connector shield part 26 earlier than the female connector contact parts 41 come into contact with the male connector contact parts 22 when the male connector module 11 and the female connector module 31 are joined.

Figure 17:
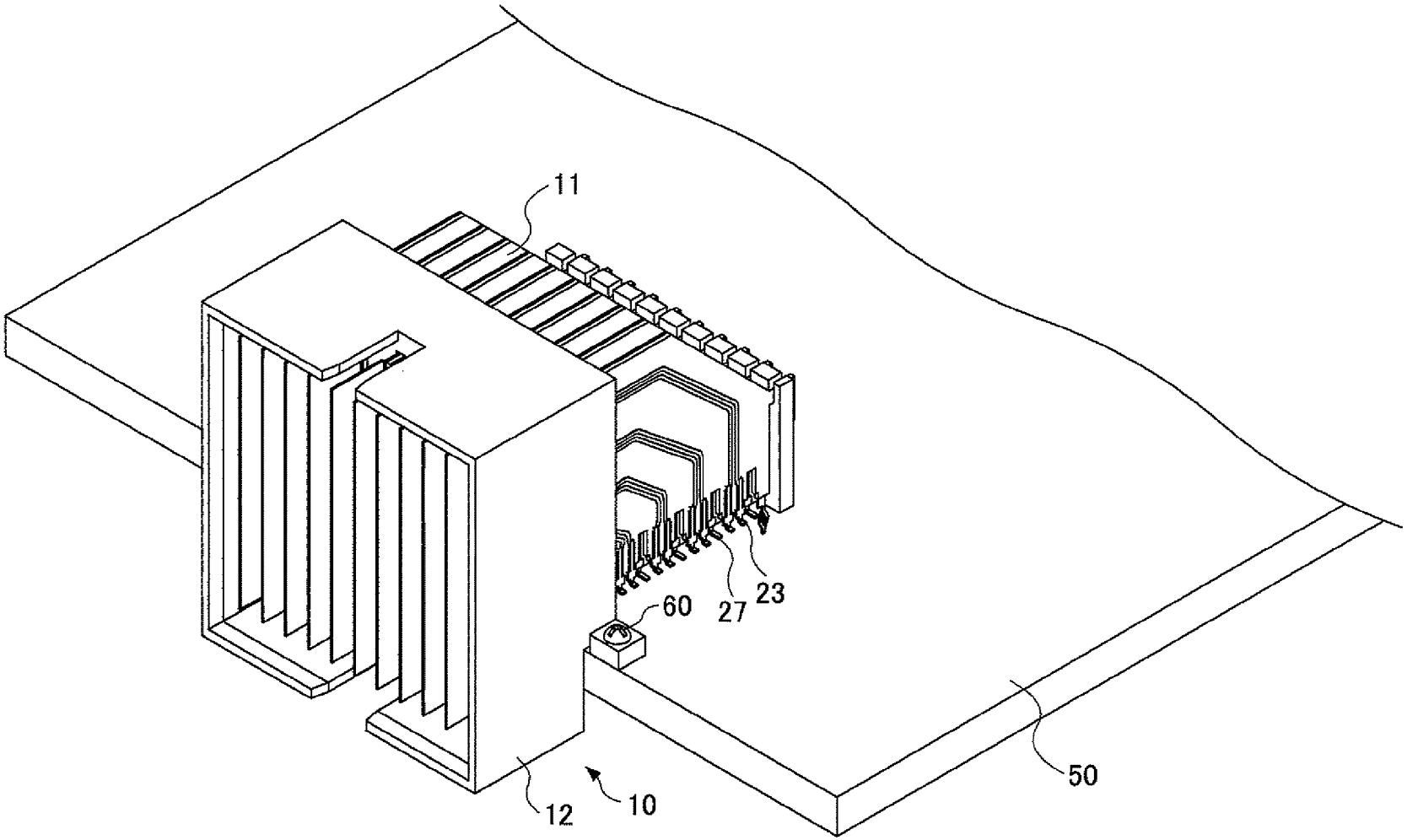
FIG. 17 is a diagram illustrating a state of mounting of the male connector according to the first embodiment of the present invention.

Next, a description is given, based on FIG. 17, of the connection of the male connector 10 and a board 50.

The male connector modules 11 of the male connector 10 according to this embodiment include the male connector terminal parts 23 and the male connector ground terminal parts 27 for connection to the board 50. In each of the male connector modules 11, the male connector terminal parts 23 and the male connector ground terminal parts 27 are formed to have an L-letter shape. The L-shaped surfaces of the male connector terminal parts 23 and the male connector ground terminal parts 27 on one side have their respective first portions joined to the interconnection parts 21 and the male connector ground part 25, respectively, along the plane direction (surface) of the male connector module 11 and have their respective second portions formed to be substantially parallel to the surface of the board 50, so that the male connector terminal parts 23 and the male connector ground terminal parts 27 may be connected to corresponding electrodes (not graphically illustrated) provided on the surface of the board 50 at the second portions of their respective L-shaped surfaces.

Forming the male connector terminal parts 23 and the male connector ground terminal parts 27 into such a shape allows the male connector terminal parts 23 and the male connector ground terminal parts 27 to be connected to the corresponding electrodes on the surface of the board 50 using SMT (Surface Mount Technology). According to this embodiment, the male connector 10 and the board 50 are fixed by screwing the housing part 12 of the male connector 10 to the board 50 with screws 60.

Figure 18:
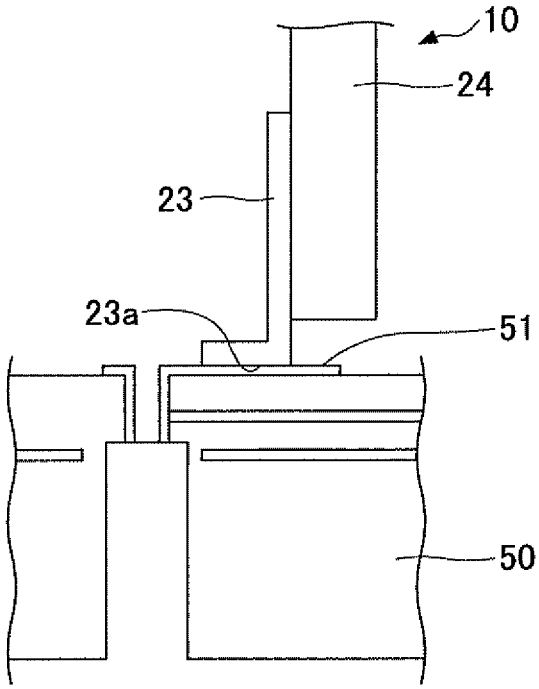
FIG. 18 is a diagram illustrating the state of mounting of the male connector according to the first embodiment of the present invention.

A description is given of SMT based on FIG. 18. Referring to FIG. 18, an electrode 51 provided on the surface of the board 50 and the male connector terminal part 23 provided on the insulating substrate 24 of the male connector module 11 in the male connector 10 are electrically connected by connecting the electrode 51 on the surface of the board 50 and a second portion 23*a* of the L-shaped surface of the male connector terminal part 23 on one side. (This description is given of the case of the male connector terminal parts 23 by way of example, and the same applies to the case of the male connector ground terminal parts 27.) Specific examples of the SMT connection include connection with solder and connection via an anisotropic conductive sheet. The SMT connection makes it possible to reduce impedance and to provide good high-frequency characteristics, etc.

Figure 19:
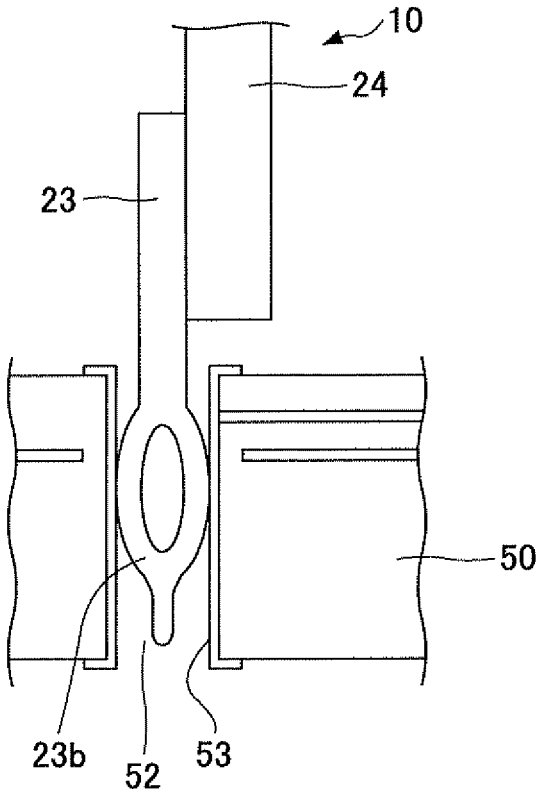
FIG. 19 is a diagram illustrating another state of mounting of the male connector according to the first embodiment of the present invention.

Further, in the case of transmitting a signal whose frequency is not so high, the connection may be established by providing the male connector terminal part 23, provided on the insulating substrate 24 of the male connector module 11 in the male connector 10, with a press-fit pin 23*b* and inserting the press-fit pin 23*b* into a through hole 52 formed in the board 50 as illustrated in FIG. 19. An electrode 53 is provided inside the through hole 52, so that the male connector 10 and the board 50 are electrically connected via the press-fit pin 23 and the electrode 53 by inserting the press-fit pin 23 into the through hole 52. The press-fit pin 23 may have the same shape as the press-fit pins 28 illustrated in FIGS. 4B and 4E, FIG. 5, and FIGS. 6A and 68.

The above description is given of a method of connecting the male connector 10 and the board 50, while the female connector 30 and the backplane board (not graphically illustrated) may be connected in the same manner.

Figure 20:
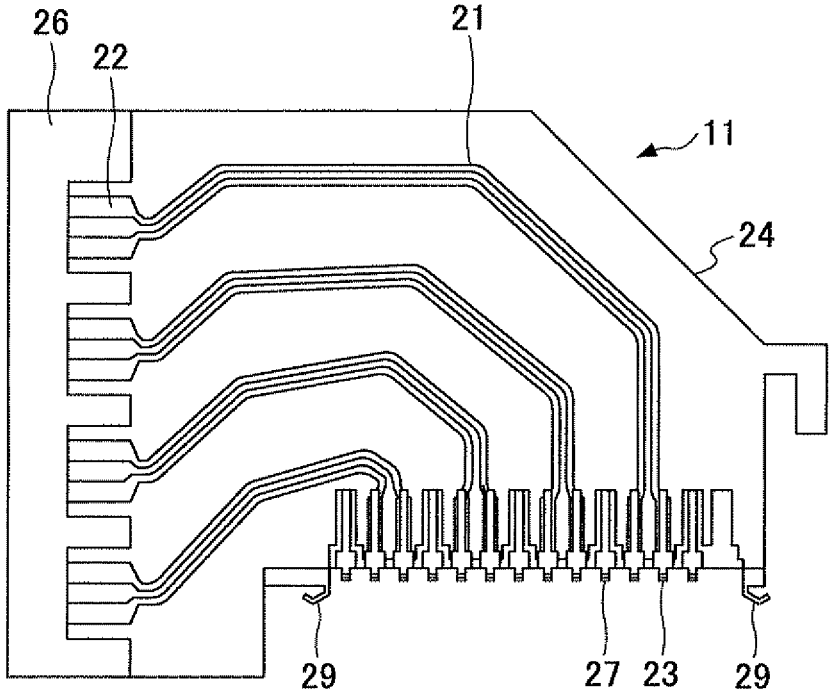
FIG. 20 is a structural diagram illustrating another configuration of the male connector module according to the first embodiment of the present invention.

The male connector module 11 having the structure illustrated in FIG. 4A through FIG. 68 is described above. The male connector module 11 may have an alternative structure as illustrated in FIG. 20, where the press-fit pins 28 are replaced with spring parts 29. The spring parts 29 come into contact with ground electrodes (not graphically illustrated) provided on the board 50 by screwing the male connector 10 to the board 50 with the screws 60 as illustrated in FIG. 17. In this case, the spring parts 29 are pressed against the board 50. Accordingly, the spring parts 29 deform in contacting the ground electrodes. Further, the connection may also be established using SMT instead of the press-fit pins 28.

[b] Second Embodiment

Next, a description is given of a second embodiment. This embodiment illustrates a connector (or a connector unit) including the male connector 10 of the first embodiment and a female connector according to this embodiment, which is different in structure from the female connector 30 of the first embodiment.

[Female Connector]

The exterior of the female connector according to this embodiment is substantially the same as that of the female connector 30 of the first embodiment. However, a female connector module 131 of the female connector of this embodiment is different in structure from the female connector modules 31 of the first embodiment.

A description is given, based on FIGS. 21A through 21F, FIG. 22, and FIGS. 23A and 235, of the female connector module 131, which is one of the female connector modules 131 of the female connector of this embodiment.

Figure 21A:
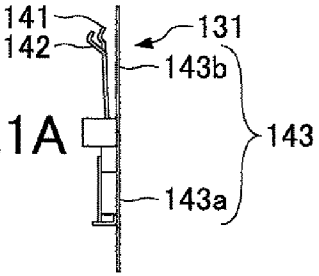
FIGS. 21A through 21F are structural diagrams illustrating a female connector module according to a second embodiment of the present invention.
Figure 21C:
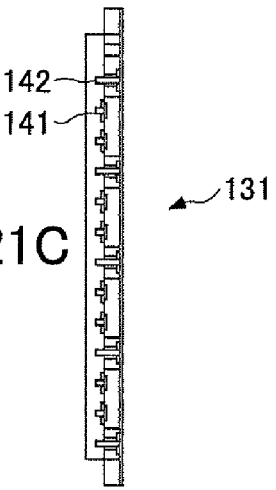
Figure 21D:
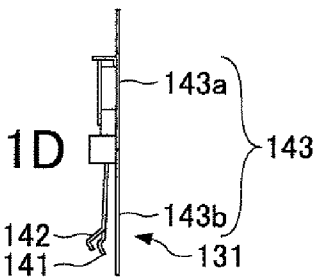
Figure 21B:
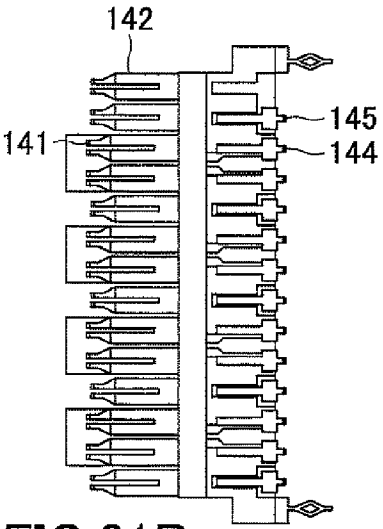
Figure 21E:
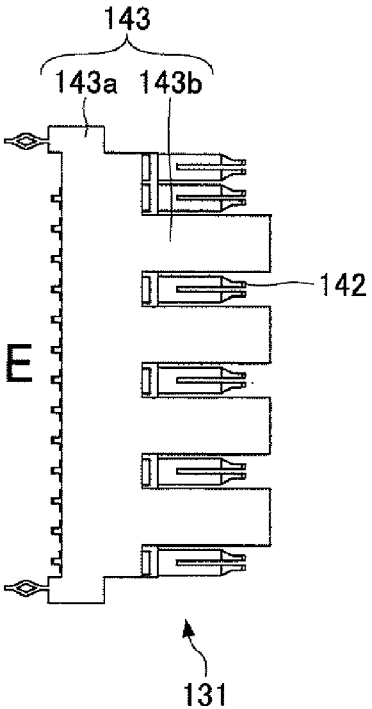
Figure 21F:
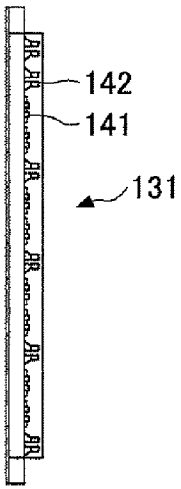
Figure 22:
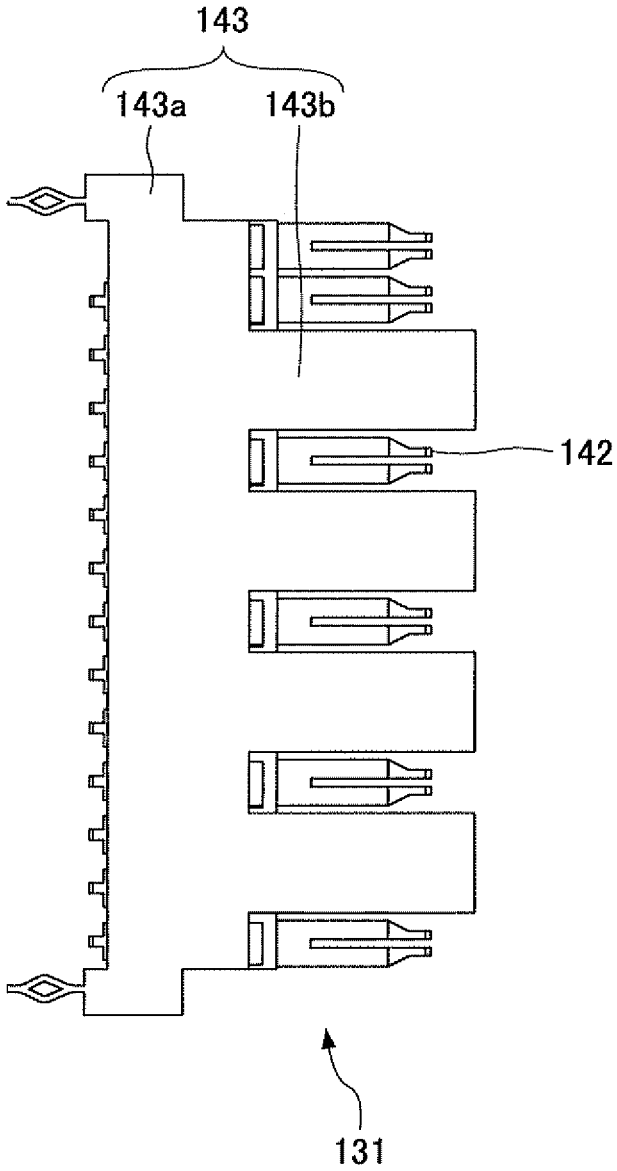
FIG. 22 is an enlarged view of FIG. 21E according to the second embodiment of the present invention.
Figure 23A:
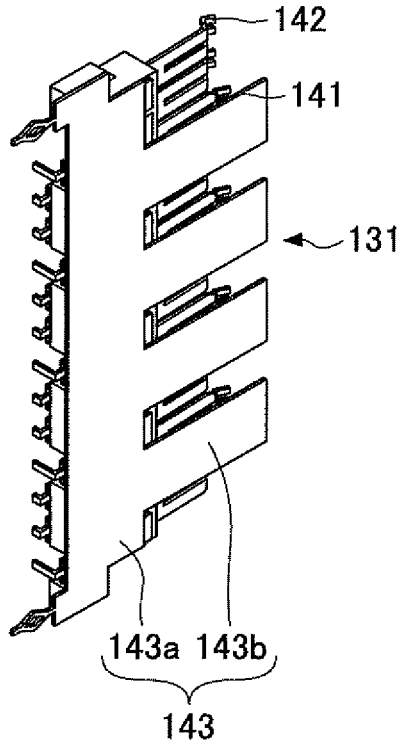
FIGS. 23A and 23B are perspective views of a female connector module according to the second embodiment of the present invention.
Figure 23B:
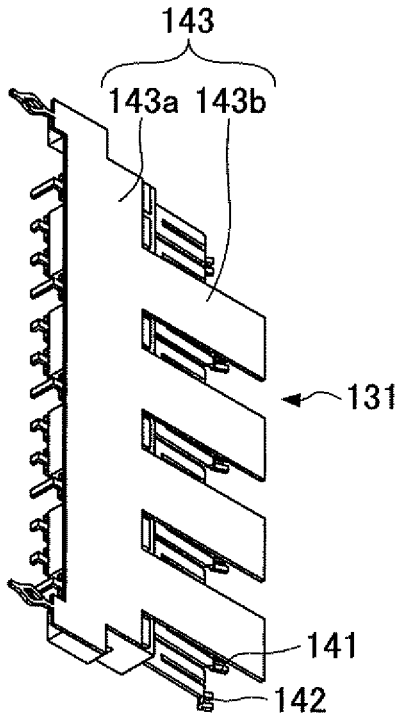

FIGS. 21A through 21F, FIG. 22, and FIGS. 23A and 23B are diagrams illustrating the female connector module 131 according to this embodiment. FIG. 21A is a rear view, FIG. 21B is a left-side view, FIG. 21C is a bottom plan view, FIG. 21D is a front view, FIG. 21E is a right-side view, and FIG. 21F is a top plan view of the female connector module 131. FIG. 22 is an enlarged view of FIG. 21E. FIG. 23A is a perspective view of the female connector module 131, illustrating its bottom, rear, and right side, and FIG. 23B is a perspective view of the female connector module 131, illustrating its bottom, front, and right side.

The female connector module 131 has spring-like female connector contact parts 141 and spring-like female connector ground contact parts 142 on the side of connection to the male connector 10 of the first embodiment. Further, a female connector shield part 143 is provided on a surface of the female connector module 131 on one side (first side), and female connector terminal parts 144 joined to the female connector contact parts 141 and female connector ground terminal parts 145 joined to the female connector shield part 143 are provided on a surface of the female connector module 131 on the other side (second side). The female connector ground contact parts 142 are connected to the female connector shield part 143.

The female connector shield part 143 includes a female connector shield body portion 143*a* and a female connector shield end portion 143*b*, which covers the female connector contact parts 141 on the first side. The female connector shield part 143, which is formed on the surface of the female connector module 31 on the side opposite to the female connector terminal parts 144 and the female connector ground terminal parts 145 so as to cover the female connector terminal parts 144, serves as an electromagnetic shield and therefore prevents the occurrence of crosstalk between the female connector module 131 and an adjacent female connector module 131. Further, like in the case of the first embodiment, in the female connector module 131, the female connector terminal parts 144 and the female connector contact parts 141 are connected with solder or an electrically conductive adhesive agent, and the female connector ground terminal parts 145 and the female connector shield part 143 are connected with solder or an electrically conductive adhesive agent. Examples of conductive paste that may be used as an electrically conductive adhesive agent include silver (Ag) paste, nickel (Ni) paste, gold (Au) paste, palladium (Pd) paste, and carbon (C) paste.

[Fitting of Male Connector and Female Connector]

Next, a description is given of the fitting of the female connector according to this embodiment and the male connector 10 illustrated in the first embodiment. The exterior of the female connector according to this embodiment and the male connector 10 illustrated in the first embodiment in the fit state is substantially the same as that in the first embodiment. Accordingly, a description is given of the inside (interior condition) of the female connector and the male connector 10 in the fit state, that is, the state of connection of the female connector module 131 and the corresponding male connector module 11.

A description is given, based on FIG. 24A through FIG. 26, of the inside (interior condition) of the male connector 10 and the female connector in the fit state according to this embodiment.

Figure 24B:
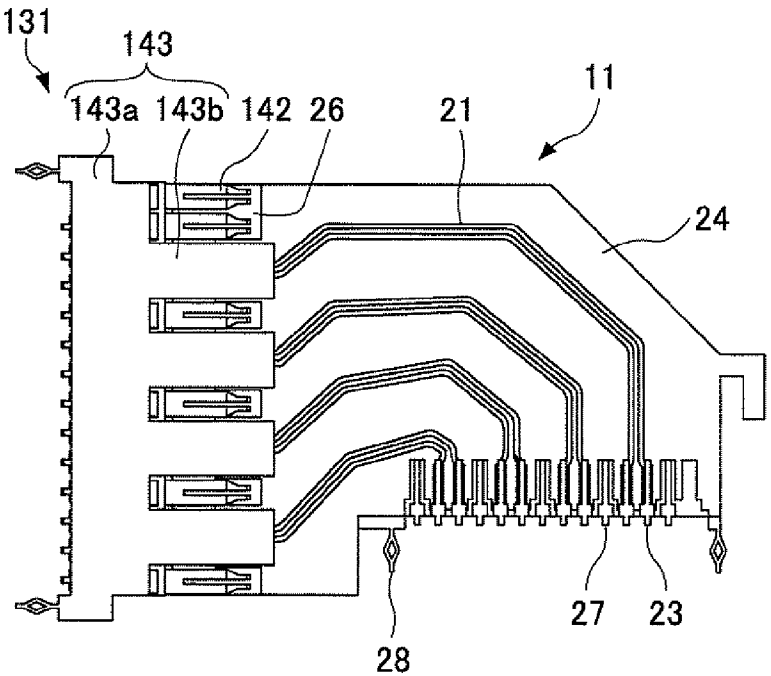
FIGS. 24A and 24B are structural diagrams illustrating the male connector module and the female connector module in a joined state according to the second embodiment of the present invention.
Figure 24A:
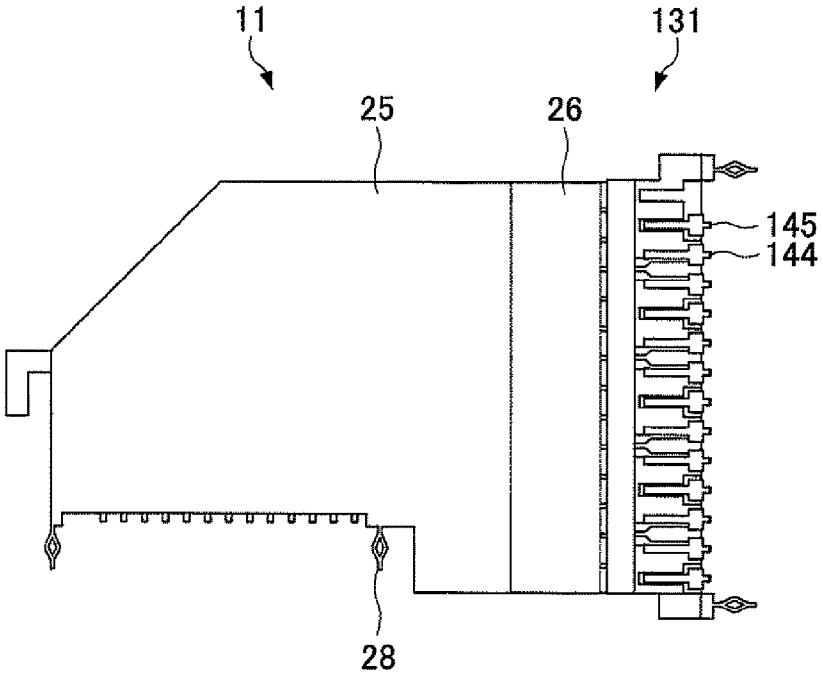
Figure 25A:
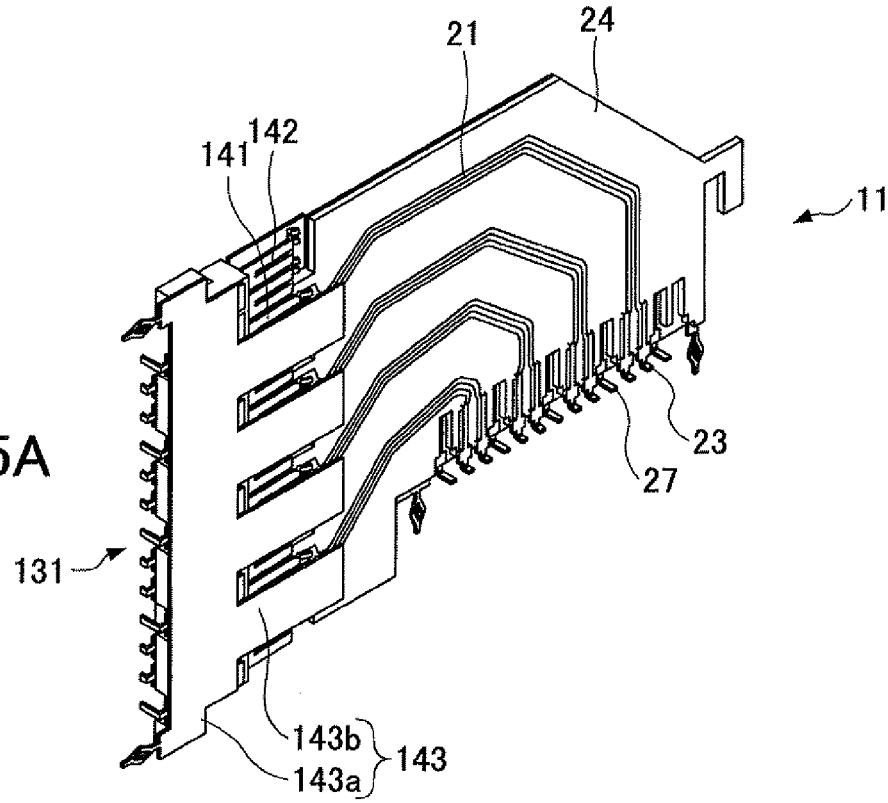
FIGS. 25A and 25B are perspective views of the male connector module and the female connector module in the joined state according to the second embodiment of the present invention.
Figure 25B:
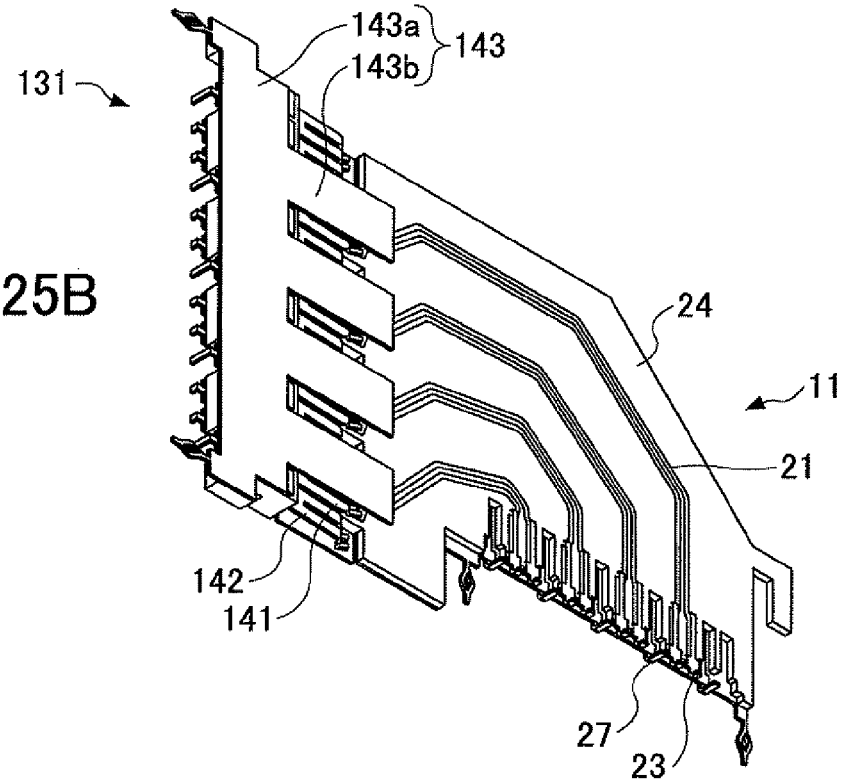

FIGS. 24A and 24B and FIGS. 25A and 25B are diagrams illustrating the male connector module 11 and the female connector module 131 in the male connector 10 and the female connector in the fit (joined) state. FIG. 24A is a left-side view and FIG. 24B is a right-side view of the male connector module 11 and the female connector module 131 fit (joined) to each other. FIG. 25A is a perspective view of the female connector module 31 fit (joined) to each other, illustrating their bottom, rear, and right side, and FIG. 25B is a perspective view of the female connector module 31 fit (joined) to each other, illustrating their bottom, front, and right side.

With the male connector 10 and the female connector in the fit state, the elastically formed female connector contact parts 141 of the female contact module 131 are in contact with and electrically connected to the corresponding male connector contact parts 22 of the male connector module 11. Further, the elastically formed female connector ground contact parts 142 of the female connector module 131 are in contact with the male connector shield part 26 of the male connector module 11. In this case, the female connector contact parts 141 are shielded by the male connector shield part 26.

Figure 26:
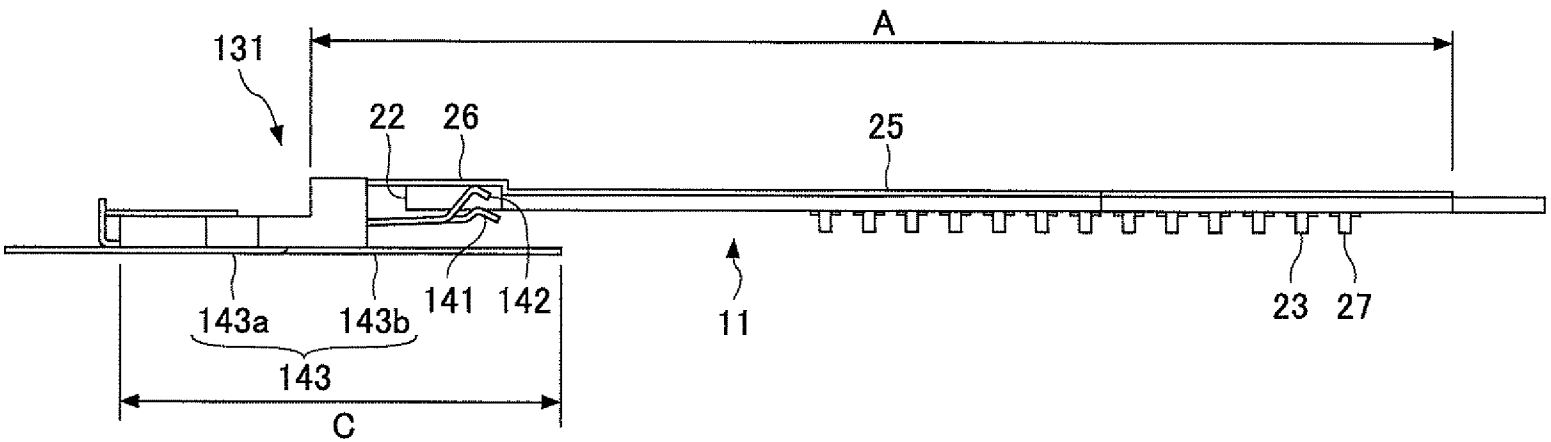
FIG. 26 is a diagram illustrating the male connector module and the female connector module in the joined state according to the first embodiment of the present invention.

A description is given in more detail based on FIG. 26. Referring to FIG. 26, a portion of the joined structure of the male connector module 11 and the female connector module 131 indicated by double-headed arrow A (region A) is shielded with the male connector ground part 25 and the male connector shield part 26 formed in the male connector module 11, and a portion of the joined structure of the male connector module 11 and the female connector module 131 indicated by double-headed arrow C (region C) is shielded with the female connector shield part 143 formed in the female connector module 31. Accordingly, the female connector contact parts 141 in the female connector module 131 are shielded on both sides with the male connector shield part 26 formed in the male connector module 11 shown in region A on one side and the female connector shield end portion 143*b* of the female connector shield part 143 formed in the female connector module 131 shown in region C on the other side. Since the female connector contact parts 141 are shielded on each side, it is possible to prevent the occurrence of crosstalk with more efficiency.

The female connector according to this embodiment, which includes multiple female connector modules 131, may be used the same as the female connector 30 of the first embodiment. Further, the connector according to this embodiment, which includes the female connector of this embodiment and the male connector 10 of the first embodiment, may be used the same as the connector of the first embodiment. The second embodiment is the same as the first embodiment except for the above-described configuration.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made hereto without departing from the spirit and scope of the invention.

What is claimed is:

1. A male connector configured to be connected to a female connector, comprising:

a plurality of male connector modules arranged side by side in a lateral direction, the male connector modules each including an insulating substrate having a first surface and a second surface facing away from each other;

a plurality of interconnection parts for electrical signal transmission on the first surface of the insulating substrate;

a male connector ground part formed on the second surface of the insulating substrate so as to substantially cover the second surface;

a plurality of male connector contact parts provided at respective first ends of the interconnection parts on the first surface of the insulating substrate;

a plurality of male connector terminal parts joined to respective second ends of the interconnection parts on the first surface of the insulating substrate; and a male connector shield part provided on a side on which the male connector is configured to be connected to the female connector, the male connector shield part being connected to the male connector ground part and projecting relative to ends of the male connector contact parts in a direction in which the male connector is configured to be connected to the female connector, wherein the male connector contact parts are provided on the first surface of the insulating substrate on a surface of the male connector shield part facing toward a same direction as the first surface of the insulating substrate.

2. The male connector as claimed in claim 1, wherein the male connector shield part is exposed between the male connector contact parts on the first surface of the insulating substrate.

3. The male connector as claimed in claim 1, wherein the interconnection parts and the male connector terminal parts are joined with one of solder and an electrically conductive adhesive agent.

4. The male connector as claimed in claim 1, further comprising:

a plurality of male connector ground terminal parts joined to the male connector ground part, wherein the male connector terminal parts and the male connector ground terminal parts are configured to be connected to corresponding electrodes provided on a board, and at least one of the connection of the male connector terminal parts to the corresponding electrodes and the connection of the male connector ground terminal parts to the corresponding electrodes is configured to be performed using a surface mount technology.

5. The male connector as claimed in claim 1, further comprising:

a plurality of male connector ground terminal parts joined to the male connector ground part, wherein the male connector terminal parts and the male connector ground terminal parts are configured to be connected to corresponding electrodes provided on a board, the male connector terminal parts and/or the male connector ground terminal parts include respective press-fit pins, and at least one of the connection of the male connector terminal parts to the corresponding electrodes and the connection of the male connector ground terminal parts to the corresponding electrodes is configured to be performed through the press-fit pins.

6. A female connector configured to be connected to a male connector, comprising:

a plurality of female connector modules arranged side by side in a lateral direction, the female connector modules each including a plurality of elastic female connector contact parts and a plurality of elastic female connector ground contact parts provided on a first side of the female contact module on which side the female connector is configured to be connected to the male connector;

a plurality of female connector terminal parts and a plurality of female connector ground terminal parts provided on a second side of the female contact module opposite to the first side, the female connector terminal parts being joined to the corresponding female connector contact parts; and a female connector shield part provided on the second side so as to cover the female connector terminal parts and the female connector ground terminal parts, the female connector shield part being connected to the female connector ground contact parts, wherein the female connector ground terminal parts are joined to the female connector shield part.

7. The female connector as claimed in claim 6, wherein the female connector shield part includes:

a female connector shield body portion configured to shield the female connector terminal parts; and a female connector shield end portion configured to shield the female connector contact parts.

8. The female connector as claimed in claim 6, wherein the female connector contact parts and the female connector terminal parts are joined with one of solder and an electrically conductive adhesive agent.

9. The female connector as claimed in claim 6, wherein the female connector terminal parts and the female connector ground terminal parts are configured to be connected to corresponding electrodes provided on a backplane board, and at least one of the connection of the female connector terminal parts to the corresponding electrodes and the connection of the female connector ground terminal parts to the corresponding electrodes is configured to be performed using a surface mount technology.

10. The female connector as claimed in claim 6, wherein the female connector terminal parts and the female connector ground terminal parts are configured to be connected to corresponding electrodes provided on a backplane board, the female connector terminal parts and/or the female connector ground terminal parts include respective press-fit pins, and at least one of the connection of the female connector terminal parts to the corresponding electrodes and the connection of the female connector ground terminal parts to the corresponding electrodes is configured to be performed through the press-fit pins.

11. A connector, comprising:

a male connector; and a female connector, wherein the male connector includes a plurality of male connector modules arranged side by side in a lateral direction, the male connector modules each including an insulating substrate having a first surface and a second surface facing away from each other;

a plurality of interconnection parts for electrical signal transmission on the first surface of the insulating substrate;

a male connector ground part formed on the second surface so as to substantially cover the second surface of the insulating substrate;

a plurality of male connector contact parts provided at respective first ends of the interconnection parts on the first surface of the insulating substrate;

a plurality of male connector terminal parts joined to respective second ends of the interconnection parts on the first surface of the insulating substrate; and a male connector shield part provided on a side on which the male connector is connected to the female connector, the male connector shield part being connected to the male connector ground part and projecting relative to ends of the male connector contact parts in a direction in which the male connector is connected to the female connector, wherein the male connector contact parts are provided on the first surface of the insulating substrate on a surface of the male connector shield part facing toward a same direction as the first surface of the insulating substrate, the female connector includes a plurality of female connector modules arranged side by side in the lateral direction, the female connector modules each including a plurality of elastic female connector contact parts and a plurality of elastic female connector ground contact parts provided on a first side of the female contact module on which side the female connector is connected to the male connector;

a plurality of female connector terminal parts and a plurality of female connector ground terminal parts provided on a second side of the female contact module opposite to the first side, the female connector terminal parts being joined to the corresponding female connector contact parts; and a female connector shield part provided on the second side so as to cover the female connector terminal parts and the female connector ground terminal parts, the female connector shield part being connected to the female connector ground contact parts, wherein the female connector ground terminal parts are joined to the female connector shield part, and the male connector contact parts and the female connector contact parts are in contact and the female connector ground contact parts and the male connector shield part are in contact with the male connector and the female connector being fit to each other.

12. The connector as claimed in claim 11, wherein the female connector ground contact parts are provided alternately with pairs of the female connector contact parts, and the male connector contact parts and the female connector contact parts are in contact and the female connector ground contact parts and the male connector shield part are in contact on a side of each of the male connector modules on which side the first surface of the insulating substrate is positioned.

13. The connector as claimed in claim 11, wherein the female connector contact parts are shielded with the male connector shield part with the male connector and the female connector being fit to each other.

* * * * *